US005674671A

United States Patent [19]

Brandon et al.

[11] Patent Number: 5,674,671

[45] Date of Patent: Oct. 7, 1997

[54] LIGHT SENITIVE MATERIAL HAVING IMPROVED ANTISTATIC BEHAVIOR

[75] Inventors: Marc Brandon, Rotterdam, Netherlands; Dirk H. C. Arren, Borsbeek; Rudolph J. Dams, Zwijndrecht, both of Belgium

[73] Assignee: Minnesota Mining and Manufacturing Company, St. Paul, Minn.

[21] Appl. No.: 495,818

[22] Filed: Jun. 27, 1995

[30] Foreign Application Priority Data

Jul. 18, 1994 [EP] European Pat. Off. ..... 94.111187

[51] Int. Cl.[6] ..... G03C 1/35

[52] U.S. Cl. ..... 430/527; 430/523; 430/528; 430/529; 430/609; 430/631; 430/627; 430/961; 430/372

[58] Field of Search ..... 430/523, 527, 430/528, 529, 609, 631, 627, 961, 372

[56] References Cited

U.S. PATENT DOCUMENTS

| | | | |
|---|---|---|---|
| 3,514,291 | 5/1970 | Vanpoecke et al. | 96/87 |
| 3,525,621 | 8/1970 | Miller | 96/85 |
| 3,589,906 | 6/1971 | McDowell | 96/87 |
| 3,589,908 | 6/1971 | Plakunov | 96/107 |
| 3,607,286 | 9/1971 | Wood | 96/87 A |
| 3,615,531 | 10/1971 | Ranzenhofer | 280/6 |
| 3,640,748 | 2/1972 | Mackey | 117/33.3 |
| 3,655,387 | 4/1972 | Collet et al. | 96/87 A |
| 3,666,478 | 5/1972 | Groh et al. | 96/114.5 |
| 3,754,924 | 8/1973 | DeGeest et al. | 430/635 |
| 3,884,699 | 5/1975 | Cavallo et al. | 96/87 A |
| 3,888,678 | 6/1975 | Bailey et al. | 96/87 A |
| 4,013,696 | 3/1977 | Babbitt et al. | 428/412 |
| 4,264,707 | 4/1981 | Uozumi et al. | 430/275 |
| 4,292,402 | 9/1981 | Pollet et al. | 430/961 |
| 4,330,618 | 5/1982 | Minamizono et al. | 430/528 |
| 4,367,283 | 1/1983 | Nakayama | 430/528 |
| 4,596,766 | 6/1986 | Nemori et al. | 430/527 |
| 4,722,758 | 2/1988 | Barrett et al. | 156/53 |
| 4,891,306 | 1/1990 | Yokoyama et al. | 430/527 |
| 4,891,307 | 1/1990 | Mukunoki et al. | 430/527 |
| 4,956,270 | 9/1990 | Tachibana et al. | 430/527 |
| 4,975,363 | 12/1990 | Cavallo et al. | 430/637 |
| 4,988,566 | 1/1991 | Glaister | 428/407 |
| 5,109,071 | 4/1992 | Johnson et al. | 525/199 |
| 5,207,996 | 5/1993 | Sierakowski | 423/27 |

FOREIGN PATENT DOCUMENTS

| | | |
|---|---|---|
| 0 300 259 | 7/1988 | European Pat. Off. . |
| 1330356 | 9/1973 | United Kingdom . |
| 1496534 | 12/1977 | United Kingdom . |
| 1524631 | 9/1978 | United Kingdom . |
| 2096782 | 10/1982 | United Kingdom . |

OTHER PUBLICATIONS

*Kirk–Othmer Encyclopedia of Chemical Technology*, vol. 8 (3rd Edition), pp. 500–515 (John Wiley and Sons, 1981).

*Kirk–Othmer Encyclopedia of Chemical Technology*, vol. 11, pp. 1–81 (John Wiley and Sons, 1981).

*Primary Examiner*—Geraldine Letscher

*Attorney, Agent, or Firm*—Gary L. Griswold; Walter N. Kirn; Daniel C. Schulte

[57] ABSTRACT

The invention relates to the use of a fluoropolymer and a fluorochemical surface active agent in combination for improving the antistatic behaviour of surfaces. In one embodiment, the invention provides a light-sensitive material possessing good initial antistatic properties and retaining good properties even after aqueous processing.

15 Claims, 1 Drawing Sheet

LIGHT SENITIVE MATERIAL HAVING IMPROVED ANTISTATIC BEHAVIOR

FIELD OF THE INVENTION

This invention relates to the use of fluorochemicals to improve the antistatic behaviour of light sensitive materials such as photographic film. It also relates to light sensitive materials comprising certain fluorochemicals that materials having improved antistatic properties.

BACKGROUND

Photographic materials generally comprise a substrate or support, such as a plastic film, that is coated on one or both sides with hydrophilic colloidal layers. The hydrophilic colloidal layers include at least one layer that is light-sensitive and may contain other non-light-sensitive layers.

Examples of substrate or support materials include films of poly-A-olefins (such as polyethylene), polyesters (such as polyethyleneterephthalate), cellulose esters (such as cellulose triacetate), paper, synthetic paper or resins-coated paper.

Since many of the materials used to make substrate or support layers for light-sensitive materials have electrical insulating properties, electrostatic charges frequently build up on light-sensitive materials during their production, processing and use. The accumulated electrostatic charge can cause various problems. For example, the discharge of accumulated electrostatic charge prior to the development of a photographic material will generate light to which silver halides are sensitive. Developed film exposed to such electrostatic discharge may exhibit dot-like marks (called positive static marks) and branch-like marks (called negative static marks) which are undesirable. This is particularly problem for X-ray materials because such marks on the developed light-sensitive material may lead to dangerous misreadings. Additionally, accumulated electrostatic charge on the support layer can attract dust or other particles to the surface of the support or substrate layer. These particles will have an undesirable effect on the quality of coating layers applied to the support or substrate layer during the manufacturing process.

In general, electrostatic charge is related to surface resistivity and charge level. Therefore, the accumulation of electrostatic charge can be prevented by reducing the surface resistivity or by lowering the charge level.

The surface resistivity of a layer may be reduced by addition to the layer of substances which increase the layer's electrical conductivity. Various processes have been described to improve the electrical conductivity of the support or substrate layers of photographic materials. Substances including water and certain hygroscopic compounds, soluble inorganic salts, surface active agents and polymers have been suggested for use in such processes. For example, U.S. Pat. Nos. 3,514,291, 3,589,908, 3,607,286 and 3,615,531 describe the use of various polymers to improve electrical conductivity. U.S. Pat. Nos. 3,589,906, 3,640,748 and 3,655,387 describe the use of certain surface active agents for such purpose. U.S. Pat. Nos. 3,525,621 and 4,264,707 describe the use of certain nitrates, metal oxides, semiconductors and colloidal silica and alumina for such purpose. Non-ionic surfactants having polyoxyethylene chains have been described as having particularly excellent antistatic properties.

Another method for lowering antistatic charge is the control of triboelectric charge generation on the surface of photographic materials. Such a method is described in U.S. Pat. No. 3,888,678. Certain fluorine containing compounds, surface active agents and polymers were described in the patent as having utility in reducing static charge generation. Also, certain fluorine containing surface active agents have been suggested for this purpose. See, for example, U.S. Pat. Nos. 3,888,678, 3,666,478, 3,589,906, 3,884,699, and 4,330,618 and in GB-A-1,330,356, 1,524,631 and 2,096,782.

Methods for improving the characteristics of static chargeability of photographic materials have also been developed and are described, for example, in U.S. Pat. Nos. 3,884,699, 4,013,696, 4,367,283, 4,596,766, 4,975,363 and GB-A-1,496,534.

Many of the methods and compositions described in the prior art for increasing the electrical conductivity of light-sensitive materials or otherwise lowering their charge level share an important shortcoming. The anti-static properties of light-sensitive materials made according to such methods or using such compositions are lost or severely diminished after the material is subjected to aqueous processing steps, such as developer and fixation steps, handling steps and storage. Furthermore, leached of antistatic agents in processing baths are undesirable contaminants.

Therefore, it would be desirable to develop a light-sensitive material possessing good initial antistatic properties that can retain good antistatic properties after it is subjected to aqueous processing steps and subsequent storage and handling.

SUMMARY OF THE INVENTION

In one aspect, the invention provides a multi-layer, light-sensitive material, such as a photographic film, having improved antistatic properties. The light-sensitive material possesses good initial antistatic properties and it retains good antistatic properties even after it is subjected to aqueous processing steps, such as developing and fixation steps, handling steps and storage. The material comprises:

(A) a substrate or support layer having two or more surfaces; and (B) coated upon the one or more support layer surfaces is one or more hydrophilic colloidal layers;

wherein at least one of the hydrophilic colloidal layers is a hydrophilic colloidal light-sensitive layer, and the topmost layer of the hydrophilic colloidal layers coated upon a coated support layer surface comprises fluoropolymer and fluorochemical surface active agent in concentrations which are effective to provide the desired resistance to the build-up electrostatic charge on the light-sensitive material.

In another aspect, the invention provides a process of improving the antistatic properties of a substrate having two or more surfaces by coating one or more surfaces of the the substrate with a coating comprising fluoropolymer and fluorochemical surface active agent.

A particularly preferred embodiment of the invention is a multi-layer, light-sensitive film, such as a photographic film, that comprises:

(A) a substrate or support layer having two surfaces, typically consisting of a polymeric film; and (B) coated upon one or both of the support layer surfaces, are two hydrophilic colloidal layers, wherein one of the hydrophilic colloidal layers is a hydrophilic colloidal light-sensitive layer, and that layer is the first hydrophilic colloidal layer coated on the support layer surface, and the other hydrophilic colloidal layer is a hydrophilic colloidal protective layer comprising fluoropolymer and fluorochemical surface active agent in effective concentrations to provide the desired resistance to the build-up of static charge on the photographic film.

Preferably, in all of the layers comprising fluoropolymer and fluorochemical surface active agent described above, the layers further comprise at least one fluorine-free surface active agent and/or at least one fluorine-free polymer.

DESCRIPTION OF THE PREFERRED EMBODIMENTS OF THE INVENTION

Figure 1:
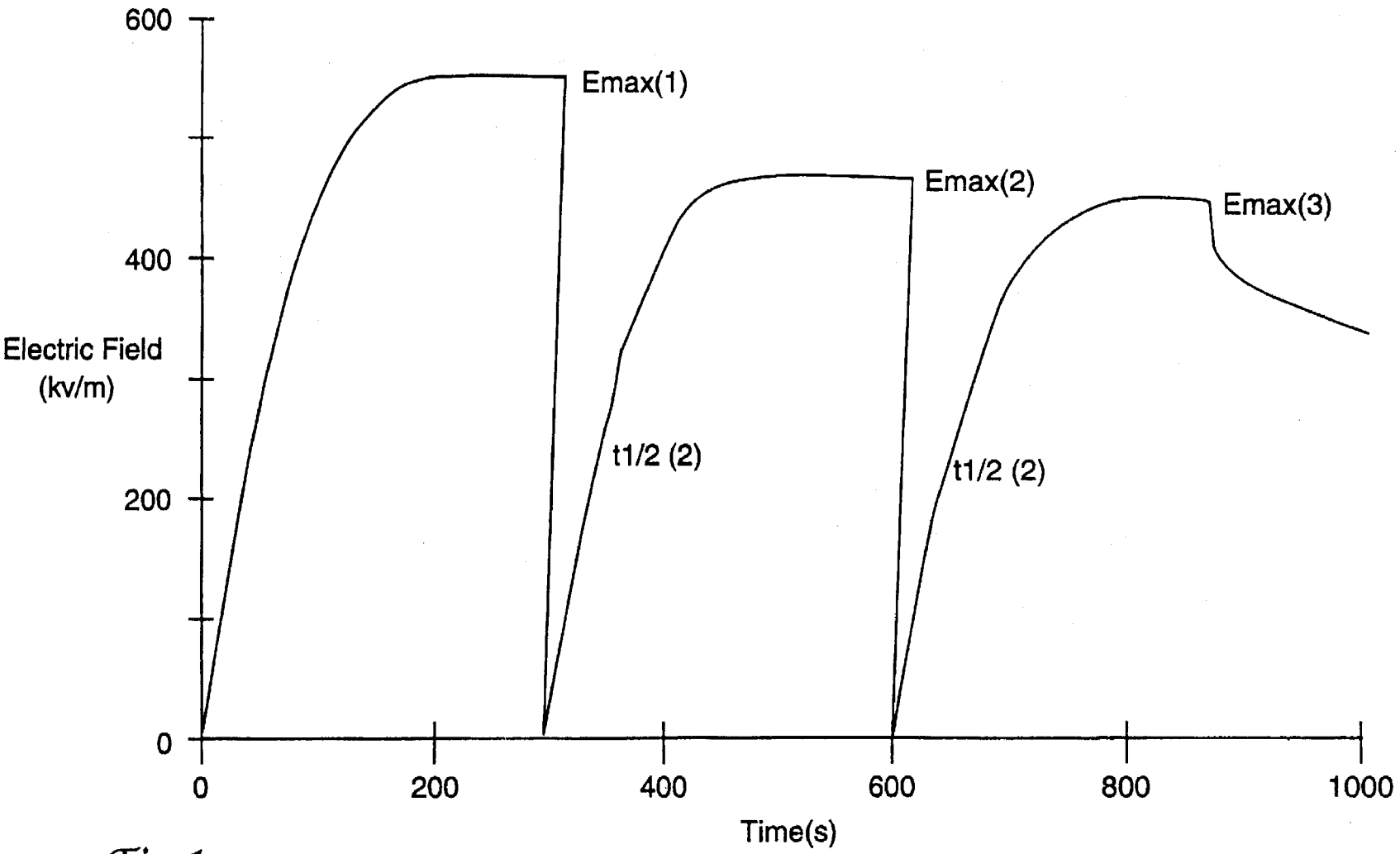
FIG. 1 is a graph of the electric field (kV/m) of a sample as it cycles through a test on the endless belt test apparatus.

The fluoropolymers useful in the present invention include fluoroelastomers and fluoroplastics comprising interpolymerized units derived from one or more ethylenically unsaturated fluorinated monomers and, optionally, one or more ethylenically unsaturated fluorine-free monomers. Preferably, the polymer consists of units derived from fluorine-containing monomers. Representative examples of useful fluoropolymers include polymers comprising interpolymerized units derived from one or more perfluorinated monoolefins and/or partially fluorinated monoolefins. Preferably, such monoolefins are straight or branched chain compounds having terminal ethylenic double bonds and contain less than six, and preferably 1 or 2, carbon atoms. Examples of useful perfluorinated monoolefins include vinylidene fluoride, hexafluoropropylene and tetrafluoroethylene and examples of useful partially fluorinated monoolefins include ethylenically unsaturated monomers containing fluorine and other substituents such as halogen atoms (e.g., chlorotrifluoroethylene) or perfluoroalkoxy groups (e.g., perfluoroalkylvinylethers in which the alkyl group contains up to six carbon atoms such as perfluoro (methylvinylether)). Examples of useful fluorine-free monomers include monoolefins having 2 to 4 carbon atoms such as ethylene and propylene.

Many of the fluoropolymers useful in this invention are known and are described in the art. For example, suitable polymers are described in U.S. Pat. Nos. 4,722,758, 4,988,566 and 5,109,071, which descriptions are herein incorporated by reference. Since some of the fluoropolymers useful in this invention are used as electrical insulation materials, it was surprising that they also could be used in this invention to reduce the build up of electric charge on light-sensitive materials.

Many of the fluoropolymers useful in this invention are commercially available. Examples of useful commercially available fluoropolymers are described in *Kirk-Othmer Encyclopedia of Chemical Technology*, Vol. 8 (3rd edition), pages 500–515 and Vol. 11, pages 1–81 (John Wiley and Sons, 1981), which description is herein incorporated by reference. Examples of commercially available fluoropolymers useful in this invention include those available from: 3M Company under the brands Fluorel™ and Kel-F™; E. I. Dupont deNemours & Company under the brands Viton™, Teflon™ and Tefzel™; Montedison SPA and Ausimont under the brands Tecnoflon™ and Alyoflon™; Daikin under the brands Dai-E™ and Daiflon™; Asahi Glass under the brands Aflas™ and Aflon™; Hoechst under the brand Hostaflon™; from Ugine Kuhlmann under the brands Voltalef™ and Floraflon™; from Allied Chemical under the brands Aclon™ and Aclar™; from Pennewalt under the brand Kynar™ and from Solvay under the brand Solef™.

Preferably, the fluoropolymers will contain at least 5% by weight of fluorine and are added to the other components of the coating composition in the form of an aqueous dispersion of the polymer (i.e., a polymer latex).

The fluorochemical surface active agents useful in the invention include fluorine-containing compounds, oligomers and polymers that contain: at least 5% by weight of carbon-bonded fluorine largely in the form of one or more fluorinated groups. The one or more fluorinated groups are linked to one or more water-solubilizing polar groups through one or more linking groups or through covalent bonds.

The fluorinated groups in the fluorochemical surface active agent generally are fluorinated, monovalent, non-aromatic groups having at least 3 carbon atoms and containing one or more fluoroaliphatic chains. The fluoroaliphatic chains in the groups may be straight, branched or cyclic aliphatic chains or combinations thereof, and may be joined to other fluoroaliphatic chains in the group or may be terminated by heteroatoms, such as oxygen, hexavalent or divalent sulfur, or trivalent nitrogen atoms, or groups containing such heteroatoms. Fully fluorinated groups are preferred, but hydrogen or chlorine atoms also may be present as substituents provided that not more than one atom of either is present for every two carbon atoms. Fluorinated groups containing about 5 to 12 carbon atoms are most preferred.

The water-solubilizing polar group or groups of the fluorochemical surface active agent can be an anionic, cationic, non-ionic or amphoteric groups, or any combination thereof. Typical anionic groups include $CO_2H$, $CO_2M$, $SO_3H$, $SO_3M$, $OSO_3H$, $OSO_3M$, $OPO(OH)_2$, and $OPO(OM)_2$, where M is a metal ion (such as sodium, potassium or calcium), or ammonium ion, or other amine cation. Typical cationic groups include $NH_2$, NHR where R is a lower alkyl group and $NR'_3{+}A^-$, where R' is hydrogen or a lower alkyl group such as methyl, ethyl or butyl, and A is an anion such as chloride, sulfate, phosphate, hydroxide or iodide. Typical non-ionic groups would include poly(oxyalkylene) moieties, e.g., those derived from polyethylene oxide, polypropylene oxide and mixed polyethylene oxide-polypropylene oxide polyols. Typical mixed or amphoteric groups would include $—N^+(CH_3)_2C_2H_4COO^-$, $—N(CH_3)_2O$, and $—N^+(CH_3)_2(CH_2)_3SO_3^-$.

Typically, the fluorinated groups and water-solubilizing groups of the fluorochemical surface active agent are linked by one or more linking groups. Generally, the linking group is a multivalent, typically divalent, group such as an alkylene (e.g., ethylene), arylene (e.g., phenylene), combinations of an alkylene and an arylene (e.g., xylylene), oxydialkylene (e.g., $CH_2CH_2OCH_2CH_2$), sulfonamidoalkylene (e.g., $SO_2N(CH_2CH_3)CH_2CH_2$), alkylenesulfonamido (e.g., $CH_2CH_2SO_2NHCH_2CH_2$), carbonamidoalkylene or other heteroatom-containing group such as a siloxane group or combinations of such groups.

Many of the useful fluorchemical surface active agents contain one or more fluorinated groups attached to a single linking group which is in turn linked to a water-solubilizing group. The fluorochemical surface active agents also include compounds containing one or more fluorinated groups wherein each fluorinated group is linked through a single linking group to one water-solubilizing group.

A particular useful class of fluorosurfactants can be represented by formula I:

$$(R_f)_nQ_xZ \qquad \text{I}$$

where, in the above formula:

$R_f$ is the fluorinated group as described above;
n is 1 or 2;
Q is the linking group as described above;
x is 0 or 1; and
Z is the water-solubilizing group as described above.

A detailed description of useful compounds described by this formula can be found in U.S. Pat. No. 5,207,996, column 4, line 27 to column 5, line 56, which description is herein incorporated by reference.

Specific examples of fluorochemical surface active agents which are useful in this invention include:

Anionic surface active agents such as: ammonium, potassium, sodium and amine perfluoroalkyl or fluorinated alkyl sulfonates and carboxylates. Such compounds are described in U.S. Pat. No. 5,207,996, column 5, line 57 to column 6, line 15, which description is herein incorporated by reference. Commercially available anionic surface active agents include Fluorad™ FC-127

Cationic surface active agents such as: fluorinated alkyl quaternary ammonium compounds. Such compounds are described in U.S. Pat. No. 5,207,996, column 6, lines 16 to 47, which description is herein incorporated by reference.

Non-ionic surface active agents such as: fluorinated alkyl ester polymers, alkoxylates or polyoxyethylene ethanol compounds. Such compounds are described in U.S. Pat. No. 5,207,996, column 7, lines 6 to 51, which description is herein incorporated by reference. Commercially available fluorosurfactants of this class include: FC-430, FC-431, Zonyl™ FSN and FC-740 available from 3M.

Amphoteric surface active agents such as: fluorinated alkyl amphoteric compounds. Such compounds are described in U.S. Pat. No. 5,207,996, column 6, line 49 to column 7, line 5, which description is herein incorporated by reference.

The preferred fluorochemical surface active agents are anionic or non-ionic compounds and examples of preferred anionic compounds include: those described in U.S. Pat. No. 5,207,996 (which description is herein incorporated by reference), products commercially available from E. I. Dupont deNemours & Company as Zonyl™ FSA and FSK and products commercially available from Bayer as FT-248. Representative examples of preferred non-ionic fluorochemical surfact active agents include: the 3M product, FC-431, and a product commercially available from DuPont as Zonyl™ FSN.

The fluorochemical surface active agent and fluoropolymer may be incorporated with the other components of coating composition and coated upon the substrate surface using conventional methods. However, the fluoropolymer and fluorochemical surface active agent need only be added to the coating layer or layers that are in contact with the film making or processing equipment which create static charge buildup on the surface of the light-sensitive material.

Preferably, fluorine-free surfactants are also added to along with the fluorochemical surface active agent and fluoropolymer to the coating composition. The fluorine-free surfactants are amphiphilic molecules comprising at least one hydrophilic head group and at least one hydrophobic tail. Generally, these surfactants include hydrocarbon and silicone wetting and spreading agents, and may be anionic, cationic, non-ionic or amphoteric, however, preferably they are anionic and non-ionic surfactants.

Many of the fluorine-free surfactants useful in this invention are known and have been described in the prior art, see, for example, *Industrial Applications of Surfactants,* D. R. Karsa, Royal Society of Chemistry, London, 1988 and McCutcheon's *Detergents and Emulsifiers,* MC Publishing Co., 1985, New York.

Representative examples of useful fluorine-free, anionic surfactants include ether sulfates, dialkyl sulfosuccinates, sulfates and sulfonates. Representative examples of useful fluorine-free, non-ionic surfactants include ethoxylated alcohols and alkyl phenols, ethylene oxide/propylene oxide block copolymers and silicone/ethylene oxide polymers.

Examples of commercially available fluorine-free, anionic surfactants include Triton™ X-200 from Rohm & Haas, Aerosol™ OT from Cyanamid and Hostapur™ SAS from Hoechst.

Examples of commercially available fluorine-free, non-ionic surfactants include:Triton™ X-102 and X-305 from Rohm & Haas; Surfynol™ 420, 440 and 465 from Air Products; Jeffamine™ M-1000 from Texaco; Pluronic™ P123 and 25RS, Tetronic™ T 1304, and Industrol™ C0-40 from BASF; Dow Corning™ Q 4-3667 from Dow Corning; Tween™ 20 from ICI; Petrarch™ PS 071 and 073 from Petrarch; Silwet™ L-7605 from Union Carbide and Tegopren™ 1038 from Goldschmidt.

Examples of commercially available fluorine-free, cationic surfactants include: Catanac™ SN from Cyanamid and Ethoquad™ and Arquad™ from Akzo.

Representative useful fluorine-free, amphoteric surfactants include betaines, amine-oxides and imidazolines. Commercially available amphoteric surfactants include: Tegobetaine™ L7 from Goldschmidt, Emcol™ LO from Witco and Miranol™ CB from Rhone Poulenc.

Preferably, fluorine-free polymers are also added to the coating composition along with the fluoropolymer and fluorochemical surface active agent and fluorine-free polymer. The fluorine-free polymers can be homopolymers and/or copolymers of alkyl acrylates and vinylidene chloride. These fluorine-free polymers are known in the photographic art as matting agents, protective agents, surface modifying agents or slipping agents. Preferably, the fluorine-free polymer or polymers are added to the coating composition in the form of a latex. The fluorine-free polymers are believed to act as as a compatibilizer between the other components of the hydrophilic colloidal layer and the fluoropolymer. The preferred fluorine-free polymer is polymethylmethacrylate.

They hydrophilic colloidal layers will also comprise one or more of the hydrophilic colloids used to prepare hydrophilic colloidal layers for photographic film and the like. Examples of such hydrophilic colloids include gelatin, cellulose, sugar or synthetic polymeric derivatives. Hydrophobic polymer particles may also be added to the mixture used to prepare the hyrophilic colloid layers to improve the characteristics of the layers. Such layers can be hardened with hardeners such as formaldehyde, glyoxal, glutaraldehyde, mucochloric acid, divinylsulfones and epoxides. Polyols such as trimethylolpropane or sorbitol can be used as plasticizers in the hydrophilic colloid layers. The hydrophilic colloid layers may further contain anti-fogging agents, such as benzothiazolium salts, mercaptothiazoles and aminothiazoles or other additives, known to those skilled in the art.

The hydrophilic colloidal light-sensitive layers of the light-sensitive material will comprise one or more dispersed silver halide, such as bromides, iodides and chlorides. According to the art, the silver halides can be chemically and spectrally sensitized. In the case of color emulsions, such layers can also comprise couplers. Upon color development of the light-sensitive material the couplers give rise to colors on the developed film. Such materials and development processes for such materials are described in *The Theory of the Photographic Process,* 3rd Ed., C. E Kenneth Mees and T. H. James, Mc Millan Publishing Co, New York.

The fluoropolymer concentration in the coating layers will be such that the final coating containing the fluoropolymer will provide an amount of fluoropolymer between 2 and 10000 mg/m$^2$, and preferably between 5 and 5000 mg/m$^2$, of the light sensitive material. The concentration of fluorochemical surface active agent in the coating layers will be such that the final coating containing the fluorochemical surface active agent will provide an amount of fluorochemical surface active agent between between 0.5 and 5000 mg/m$^2$, and preferably between 2 and 2000 mg/m$^2$, of the light sensitive material. The optional fluorine-free surfactants in the coating layers will be such that the final coating containing the fluorine-free surfactant will provide an amount of fluorine-free surfactant between about 1 and 3000 mg/m$^2$, and preferably between 10 and 2000 mg/m$^2$, of the light senstitive material. When used, the amount of fluorine-free polymer in the coating layers will be such that the final coating containing the fluorine-free polymer will provide an amount of fluorine-free polymer between about 0.5 and 10000 mg/m$^2$ and preferably between 5 and 5000 mg/m$^2$, of the light sensitive material. Said ranges will vary depending on several factors including the type of support layer, light-sensitive emulsion and manufacturing process used to make the light-sensitive material.

The invention is further described by the following non-limiting examples.

EXAMPLES

The following test method was used to evaluate the materials prepared in the following Examples. Supports coated with a hydrophilic colloid layer comprising a fluoropolymer, a fluorochemical surface active agent and optionally a fluorine-free surfactant and fluorine-free polymer were tested for their antistatic properties by measuring their charging behavior using an endless belt apparatus that simulates film transport in photographic film processing equipment.

The film transport velocity was 100 to 200 m/min. The apparatus was equipped with an electrostatic field meter and an electrostatic charge elimination device.

As soon as the belt was started, an electric field was generated which was proportional to the charge density on the film. This was measured as a function of time by the electrostatic field meter. A forced discharge of the web could be accomplished using a static elimination device.

A typical experiment is outlined below. FIG. 1 is used to further describe the procedure.

1. The experiment was started at a belt velocity of 100 m/min. The electric field was measured as a function of time until a constant maximum in electric field was reached (Emax(1)).
2. Discharge was accomplished by the electrostatic charge elimination device. At constant velocity the electric field was built-up until a constant maximum value (Emax(2)) was reached. The time necessary to build up half of this value was measured (t½(2)).
3. The procedures of discharging and charging were repeated. Emax(3) and t½(3) were noted.
4. At constant Emax(3), the belt was stopped and the decay of the charge density was measured using the electric field meter. The time needed for half of the electric field to flow off was noted (t½ discharging).

All examples and comparative examples were made by first preparing a premix or binder which was subsequently coated onto a support.

Examples 1 to 3 and Comparative Examples C1 to C3

Examples 1 to 3 and Comparative Examples C1 to C3 were made using the procedure described below. To 2,000 g of deionized water were added, in the given order, 100 g of 5 wt. % gelatin with a calcium/magnesium content lower than 150 ppm (e.g. available from Sanofi Bio-Industries), 20 g of wetting agent (a 1 wt. % solution of sodium dialkylsulfosuccinate in an ethanol and water mixture), 20 g of fluorochemical surface active agent, 180 g of a 30 wt. % dispersion in water of fluoropolymer and 1 g of a 1 wt. % solution of formaldehyde in water. The fluorochemical surface active agents and fluoropolymers used in examples 1 to 3 are given in Table 1. Comparative example C1 was made without fluorochemical surface active agent and fluoropolymer, C2 was made without fluorochemical surface active agent and C3 was made without fluoropolymer. The so-formed mixtures were coated, at a pH between 5 and 6, on a support of polyethyleneterephthalate which was pre-coated with an antistatic subbing layer (i.e., a sulfonated polystyrene with a polyfunctional crosslinking agent). The coatings were settled at 8° C. and air-dryed between 20° and 38° C. Dry coating weights of 3 to 6 g binder/m$^2$ were prepared and the samples were stored for 2 weeks at a constant relative humidity of 34% and a temperature of 20° C. The antistatic behavior of the samples was measured using the endless belt apparatus as described above. In order to evaluate the permanence of the antistatic behavior, tests were done before and after processing the coatings in aqueous processing baths.

The composition of the samples and the results obtained with the endless belt apparatus are given in Table 1.

TABLE 1

Composition of antistatic layers and their antistatic behaviour before and after processing

| Ex. No. | Fluoro-surfactant | Fluoro-polymer | Emax(2)(XV/m) Before processing | Emax(2)(XV/m) After processing |
|---|---|---|---|---|
| 1 | FC-127[1] | Terpolymer[3] | 35–40 | 120 |
| 2 | FC-127[1] | Copolymer[4] | 30 | 100 |
| 3 | Zonyl™ FSN[2] | Terpolymer[3] | 60 | 100 |
| C1 | — | — | 240 | — |
| C2 | — | Terpolymer[3] | 280 | 370 |
| C3 | FC-127[1] | — | 40 | 380 |

[1]FC-127 is a fluorochemical surfactant commercially available from available from 3M.
[2]Zonyl™ FSN is a fluorochemical surfactant commercially available from E.I. DuPont deNemours & Company.
[3]A 30 wt. % solids aqueous emulsion (latex) of a tetrafluoroethylene/hexafluoropropylene/vinylidene fluoride copolymer. Available from 3M as L-11838.
[4]A 30 wt. % solids aqueous emulsion (latex) of a hexafluoropropylene/vinylidene fluoride copolymer. Available from 3M as L-11837.

The data in Table 1 demonstrates that the films coated with hydrophilic colloidal layers comprising fluorochemical surface active agent and fluoropolymer have surprisingly good antistatic properties. Although good initial antistatic properties were obtained on a film coated with a hydrophilic colloidal layer containing only the fluorochemical surface active agent (Example C3), the film did not retain good antistatic properties after processing.

Example 4 and Comparative Example C4

In these examples, the antistatic behavior of coated samples before and after processing was investigated. The electric field and the time to build up and discharge half of the maximum electric field value (t½ charging and discharging) were recorded for each of the samples. Example 4 and Comparative Example C4 were prepared the same as Examples 1 and Cl, respectively. The results of evaluations are provided in Table 2.

TABLE 2

| Ex. No. | Processed | Emax(2) (KV/m) | Emax(3) (KV/m) | t½(2) (charge) (sec) | t½(3) (charge) (sec) | t½ (dis-charge) (sec) |
|---|---|---|---|---|---|---|
| 4 | No | 5 | 5 | 0 | 0 | 0 |
| | Yes | 40 | 40 | 15 | 15 | <3 |
| C4 | No | 240 | 240 | 30 | 36 | 240 |
| | Yes | 378 | 382 | 54 | 48 | — |

Although the composition of Example 4 was the same as that of Example 1, better results were obtained in this experiment. However, the diferences were not considered significant and were within acceptable experimental deviation. The data in Table 2 shows that remarkably good antistatic behavior was obtained from a film coated with a composition comprising the fluorochemical surface active agent and fluoropolymer in contrase to a film coated with a composition that did not contain fluorochemical surface active agent and fluoropolymer.

Example 5 and Comparative Example C5

In Example 5 and Comparative Example C5 the coating compositions prepared in Example 1 and Comparative Example C1 were coated onto polyethyleneterephthalate supports which were not precoated with an antistatic subbing layer. The results of antistatic behavior are given in Table 3.

TABLE 3

| | Emax(2) (KV/m) | |
|---|---|---|
| Ex. No. | before processing | after processing |
| 5 | 140 | 160 |
| C5 | 610 | 640 |

The data in Table 5 shows that even without an antistatic subbing layer, the antistatic behaviour achieved by the film prepared according to the invention is very good. Example 5 shows an electric field value after processing that is far below the value of the Comparative Example containing a antistatic subbing layer (see Examples C2 and C3).

Example 6

Example 6 was made according to the procedure of Example 1, with the exception that 50% by weight of the fluoropolymer latex was replaced by a polymethylmethacrylate latex. The polymethylmethacrylate latex was prepared by emulsion polymerization of methylmethacrylate at 30% solids by weight. The reaction was done under nitrogen atmosphere at a temperature of 65° C. using 0.2% by weight of initiator Vazo™ V-50 (available from E. I. DuPont deNemours & Company) and 5% by weight of Siponate™ DS-10 (an emulsifier available from Alcolac) were used.

The composition was coated onto a support precoated with an antisubbing layer as in Example 1. The dryed film showed a strong improvement with regard to transparency and clearness as compared to the foregoing examples.

While the invention has been described in terms of specific embodiments, it should be understood that it is capable of further modification. The claims herein after are intended to cover those variations that one skilled in the art would recognize as the chemical equivalent of what has been described here.

We claim:

1. A multi-layer, light-sensitive material that resists buildup of an electrostatic charge, even after it is subjected to aqueous processing steps, comprising:

(A) a support layer having two or more surfaces; and (B) coated upon one or more of the support layer surfaces, is one or more hydrophilic colloidal layers;

wherein at least one of the hydrophilic colloidal layers is a hydrophilic colloidal light-sensitive layer, and the topmost hydrophilic colloidal layer coated upon each hydrophilic-colloidal-layer-coated support layer surface comprises fluoropolymer and fluorochemical surface active agent in concentrations which are effective to provide the desired resistance to the build-up of electrostatic charge on the light-sensitive material, and wherein the fluoropolymer is a homopolymer or copolymer of fluorinated monoolefin monomers containing no ether linkage, no ester linkage and less than six carbon atoms.

2. A material according to claim 1 wherein the material is a light-sensitive film and comprises:

(A) a support layer having two surfaces; and (B) coated upon one or both of the support layer surfaces are two hydrophilic colloidal layers;

wherein one of the hydrophilic colloidal layers is a hydrophilic colloidal light-sensitive layer, and that layer is the first hydrophilic colloidal layer coated on the support layer surface, and the other hydrophilic colloidal layer is a hydrophilic colloidal layer comprising fluoropolymer and fluorochemical surface active agent in effective concentrations to provide the desired resistance to the build-up of static charge on the light-sensitive film, and wherein the fluoropolymer is a homopolymer or copolymer of fluorinated monoolefin monomers containing no ether linkage, no ester linkage, and less than six carbon atoms.

3. The material according to claim 1, wherein the fluoropolymer is a homopolymer or a copolymer of fluorinated monomers selected from the group consisting of vinylidene fluoride, hexafluoropropylene, chlorotrifluoroethylene, and tetrafluoroethylene.

4. The material according to claim 1, wherein the fluoropolymer is a copolymer of one or more of the fluorinated monoolefin monomers and at least one fluorine-free monomer.

5. The material according to claim 4, wherein the fluorine-free monomer is selected from the group consisting of ethylene and propylene.

6. The material according to claim 1, wherein the fluorochemical surface active agent is selected from the group consisting of anionic, cationic, non-ionic and amphoteric fluorine-containing surfactants.

7. The light-sensitive material according to claim 6, wherein the fluorochemical surface active agent is represented by the following formula:

$$(R_f)_nQ_xZ$$

where, in the above formula:

$R_f$ is a fluorinated radical having about 5 to 12 carbon atoms and consisting of one or more fluoroaliphatic chains selected from the group consisting of: straight, branched, cyclic aliphatic chains or combinations thereof which chains are joined together by heteroatoms, such as oxygen, hexavalent or divalent sulfur, or trivalent nitrogen atoms, or groups containing such heteroatoms;

n is 1 or 2;

Q is a linking group that is selected from the group consisting of: a covalent bond and alkylene, arylene, sulfonamidoalkylene, alkylenesulfonamido, carbonamidoalkylene and siloxane groups and combinations of such groups;

x is 0 or 1; and

Z is a water-solubilizing group and is selected from the group consisting of: anionic, cationic, non-ionic or amphoteric groups or combinations thereof.

8. The light-sensitive material according to claim 7, wherein Z is an anionic group and is selected from the group consisting of: $CO_2H$, $CO_2M$, $SO_3H$, $SO_3M$, $OSO_3H$, $OSO_3M$, $OPO(OH)_2$, and $OPO(OM)_2$, where M is a metal ion, ammonium ion, or other amine cation.

9. The light-sensitive material according to claim 7, wherein Z is a non-ionic group and is a poly(oxyalkylene) moieties.

10. The light-sensitive material according to claim 7, wherein Z is a cationic group and is selected from the group consisting of: $NR_3^+A^-$, where R is selected from the group consisting of: hydrogen or methyl, ethyl and butyl groups, and A is an anion selected from the group consisting of: chloride, sulfate, phosphate, hydroxide or iodide.

11. The material according to claim 1, wherein the hydrophilic colloidal layer comprising fluoropolymer and fluorochemical surface active agent further comprises fluorine-free polymer and fluorine-free surfactant.

12. The material according to claim 11, wherein the fluorine-free polymer is polymethylmethacrylate.

13. A process for improving the antistatic properties of a light-sensitive material comprising a support layer having one or more surfaces upon at least one of which undesirable electrostatic charges are generated, which process comprises:

applying to the surfaces of the support layer upon which undesirable electrostatic charges are generated a coating comprising fluoropolymer and fluorochemical surface active agent in effective concentrations to provide the desired level of resistance to electrostatic charge build-up on the light-sensitive material, wherein the fluoropolymer is a homopolymer or copolymer of fluorinated monoolefin monomers containing no other linkage, no ester linkage, and less than six carbon atoms.

14. The process according to claim 13, wherein the coating comprising fluoropolymer and fluorochemical surface active agent further comprises hydrophilic colloids.

15. The process according to claim 14, wherein the coating further comprises fluorine-free polymer and fluorine-free surfactant.

* * * * *

UNITED STATES PATENT AND TRADEMARK OFFICE

CERTIFICATE OF CORRECTION

PATENT NO.: 5,674,671

DATED: October 7, 1997

INVENTOR(S): Marc Brandon, Dirk H.C. Arren and Rudolph J. Dams

It is certified that error appears in the above-identified patent and that said Letters Patent is hereby corrected as shown below:

Column 12, line 22, delete "other" and replace with --ether--.

Signed and Sealed this

Fifteenth Day of September, 1998

*Attest:*

*Attesting Officer*

Bruce Lehman

BRUCE LEHMAN

*Commissioner of Patents and Trademarks*